US010273697B2

(12) United States Patent
Horton et al.

(10) Patent No.: US 10,273,697 B2
(45) Date of Patent: Apr. 30, 2019

(54) IMPERVIOUS WALL PANEL

(71) Applicant: BUSHBOARD LTD, Wellingborough, Northamptonshire (GB)

(72) Inventors: Neil Horton, Southwick (GB); Shashi Patel, Wellingborough (GB)

(73) Assignee: BUSHBOARD LTD, Wellingborough (GB)

( * ) Notice: Subject to any disclaimer, the term of this patent is extended or adjusted under 35 U.S.C. 154(b) by 0 days.

(21) Appl. No.: 15/557,287

(22) PCT Filed: Feb. 23, 2016

(86) PCT No.: PCT/GB2016/050459
§ 371 (c)(1),
(2) Date: Sep. 11, 2017

(87) PCT Pub. No.: WO2016/142647
PCT Pub. Date: Sep. 15, 2016

(65) Prior Publication Data

US 2018/0058076 A1 Mar. 1, 2018

(30) Foreign Application Priority Data

Mar. 11, 2015 (GB) ..... 1504115.5

(51) Int. Cl.
*E04F 13/08* (2006.01)
*E04F 13/16* (2006.01)

(52) U.S. Cl.
CPC ..... *E04F 13/0866* (2013.01); *E04F 13/0885* (2013.01); *E04F 13/0894* (2013.01); *E04F 13/16* (2013.01)

(58) Field of Classification Search
CPC ..... E04F 13/0866; E04F 13/0885; E04F 13/0894; E04F 13/16
See application file for complete search history.

(56) References Cited

U.S. PATENT DOCUMENTS 2,527,903 A * 10/1950 Axlrod ..... A47C 27/04 24/457
2,693,102 A * 11/1954 Luster ..... E04F 13/0885 52/309.3

(Continued)

FOREIGN PATENT DOCUMENTS

| | | |
|---|---|---|
| DE | 10001227 | 5/2001 |
| DE | 102008051441 | 3/2010 |
| DE | 102012102379 | 3/2013 |

*Primary Examiner* — Paola Agudelo
(74) *Attorney, Agent, or Firm* — Welsh Flaxman & Gitler LLC

(57) ABSTRACT

A wall panel (20, 30) suitable for bathrooms, wetrooms and the like is disclosed. The panel is water impervious and comprises a core of wood plastics composite (WPC) and a laminate adhesively attached to the core. In preferred embodiments, the core is a wood plastics composite foamed board. The wood plastics composite preferably comprises PVC and wood fiber. The wood plastics composite may include recycled materials. The wall panel may be provided with a tongue-and-groove interlocking system with tongue and groove edges (21, 31 and 32). The system is configured to provide a contact area across less than the thickness of the panel which achieves a tight join at the front face and eliminates a visible gap. It also increases tolerance for machining errors or variation. The tongue-and-groove interlocking system is designed to provide tolerance for walls which are not precisely planar but may be bowed or uneven to a certain extent.

6 Claims, 5 Drawing Sheets

(56) References Cited

U.S. PATENT DOCUMENTS 3,579,396 A * 5/1971 Washburn et al. ... B31F 1/2827 156/202
3,624,236 A * 11/1971 Frappier ..... B31F 1/2827 428/126
4,372,901 A * 2/1983 Kim ..... B29C 44/18 264/261
6,874,292 B2 * 4/2005 Moriau ..... B27F 1/06 52/586.1
8,028,486 B2 * 10/2011 Pervan ..... E04F 15/04 428/50
8,061,104 B2 * 11/2011 Pervan ..... E04F 15/02 52/591.1
2002/0020127 A1 * 2/2002 Thiers ..... E04F 15/02 52/403.1
2004/0035077 A1 2/2004 Martensson et al.
2004/0211144 A1 * 10/2004 Stanchfield ..... E04F 15/02 52/578
2005/0208255 A1 * 9/2005 Pervan ..... B32B 21/02 428/60
2006/0032175 A1 * 2/2006 Chen ..... B32B 3/04 52/578
2007/0116931 A1 * 5/2007 Lu ..... B44C 5/0461 428/167
2007/0283654 A1 * 12/2007 Stanchfield ..... B23D 45/003 52/465
2009/0173030 A1 * 7/2009 Gulbrandsen ..... E04B 9/0414 52/506.09
2010/0055420 A1 * 3/2010 Vermeulen ..... B27N 3/06 428/207
2011/0239574 A1 * 10/2011 Morris ..... E04D 13/1631 52/506.06
2015/0343739 A1 * 12/2015 Pervan ..... B32B 5/30 52/582.1
2016/0083965 A1 * 3/2016 Baert ..... E04F 13/18 52/309.15
2016/0288447 A1 * 10/2016 Cordeiro ..... B32B 3/06
2017/0165936 A1 * 6/2017 Schulte ..... B32B 3/08

* cited by examiner

IMPERVIOUS WALL PANEL

The present invention relates to a wall panel, and in particular to a water-impervious wall panel suitable for bathrooms, wetrooms and the like.

BACKGROUND

Current wall panels for bathrooms, etc. are almost exclusively manufactured using wood based substrates with unfinished edges. These require extrusions, end-caps and silicone to provide protection from water ingress, panel delamination and damage to the building infrastructure. The silicone seal will break down over time and need replacing. The integrity of the wall covering is dependent on how well the panels are installed. The extensive use of extrusions detracts from the aesthetic of the installation and reduces the maintenance benefits of avoiding tile grout lines.

SUMMARY OF THE INVENTION

In accordance with the invention, there is provided a water impervious wall panel comprising a core of wood plastics composite (WPC) and a laminate adhesively attached to the core.

In preferred embodiments, the core is a wood plastics composite foamed board. The wood plastics composite preferably comprises PVC and wood fibre. The wood plastics composite may include recycled materials.

The laminate is preferably a high pressure laminate.

The adhesive is preferably a polyurethane adhesive.

Although the laminate may be attached only to one major surface of the core, preferably the laminate is attached to both major surfaces of the core to improve the water-impervious properties of the panel.

In a preferred embodiment, the wall panel is provided with a rolled edge along at least one side. This provides a more aesthetically-pleasing edge.

A plurality of panels may be placed next to one another to cover a larger area than just one panel. To facilitate a secure join between panels, the wall panel may be provided with a tongued or grooved edge along at least one side. Preferably, the wall panel is provided with a tongue-and-groove interlocking system. Such a system may be configured to provide a contact area across less than the width of the panel. The contact area is preferably provided adjacent to the front face of the panel. This achieves a tight join at the front face and eliminates a visible gap. It also increases tolerance for machining errors or variation. The system as a whole is designed to provide tolerance for walls which are not precisely planar but may be bowed or uneven to a certain extent. The tongue may be provided with a bevelled edge, which allows the panel to be inserted at an angle.

The wall panel in accordance at least with preferred embodiments of the invention is made from a core of wood plastics composite (WPC) material covered with a laminate which is bonded to the core by means of adhesive. The resulting panel is water-impervious and the system does not require the use of joining extrusions between the panels when a plurality of panels are placed next to each other. This simplifies installation and reduces cost. The combination of materials in the panels themselves results in a panel which is not only water-impervious but also has excellent insulating characteristics which will help retain room temperature and reduce wall panel surface condensation.

DETAILED DESCRIPTION

Embodiments of the invention will now be described by way of example only and with reference to the accompanying drawings, in which.

Figure 1:
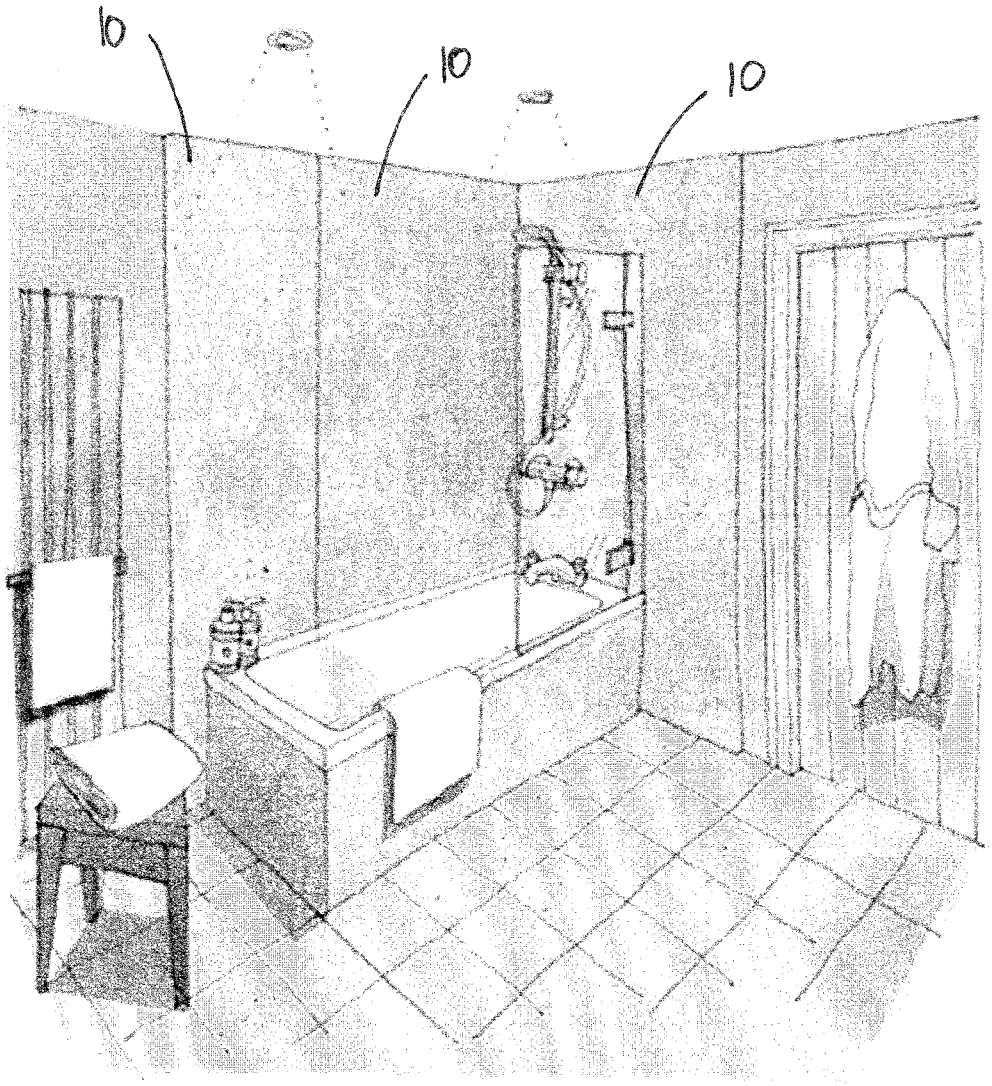
FIG. 1 shows a general perspective view of a typical bathroom employing wall panels in accordance with the invention.

With reference to FIG. 1, a typical bathroom is fitted with wall panels 10 in the areas likely to come into contact with water.

Figure 2:
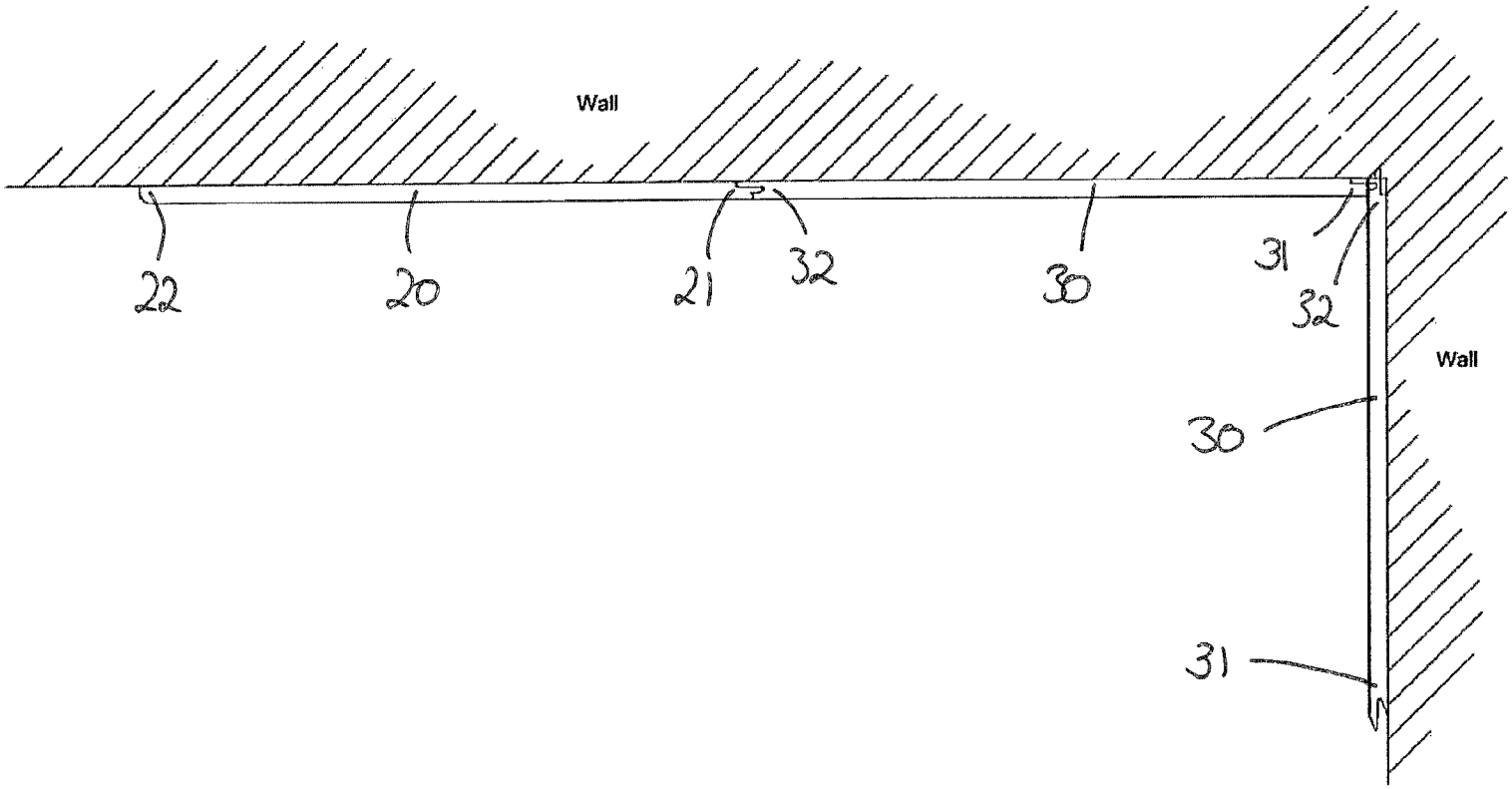
FIG. 2 shows a plan cross-sectional view of an installation employing wall panels in accordance with the invention.

FIG. 2 shows a plan cross-sectional view of an installation employing wall panels in accordance with the invention, which could be employed in the bathroom of FIG. 1. This installation employs an end panel 20 and two intermediate panels 30. The intermediate panels 30 are provided with tongue and groove edges 31 and 32 whereas end panel 20 has one tongue or groove edge 21 and a rolled edge 22 to make the exposed end of the panel aesthetically pleasing. In the corner where the two intermediate panels 30 meet, the tongue and groove edges 31 and 32 are scribed to fit, so that the outer, visible surfaces of each panel mate together.

Figure 3:
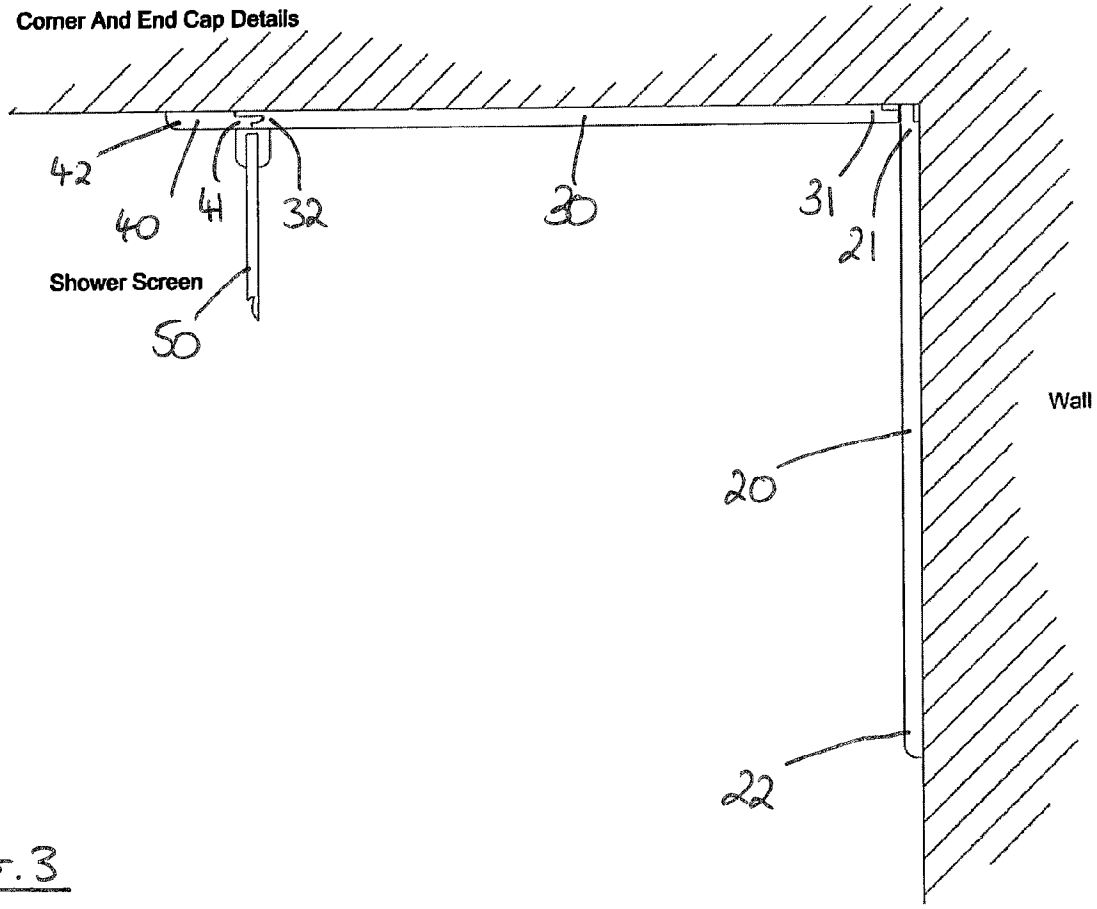
FIG. 3 shows a plan cross-sectional view of another installation employing wall panels in accordance with the invention.

FIG. 3 shows a plan cross-sectional view of another installation employing wall panels in accordance with the invention, such as a shower installation. This installation employs an end panel 20, an intermediate panel 30 and an end strip 40. As with FIG. 2, end panel 20 has one tongue or groove edge 21 and a rolled edge 22, and intermediate panel 30 is provided with tongue and groove edges 31 and 32. End strip 40 is similar to end panel 20, with one tongue or groove edge 41 and a rolled edge 42, but is narrower in width. A section of shower screen 50 is also shown. In the corner where the end panel 20 and the intermediate panel 30 meet, the tongue and groove edges 21 and 31 are scribed to fit, so that the outer, visible surfaces of each panel mate together.

Figure 4:
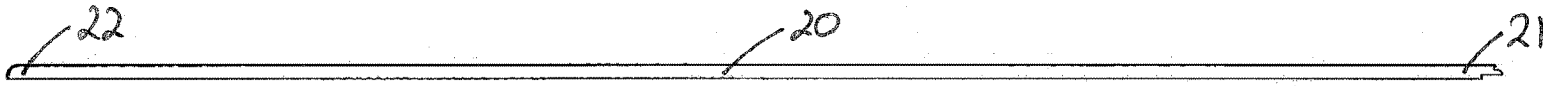
FIG. 4 shows a cross-sectional view of a wall panel in accordance with a preferred embodiment.

FIG. 4 shows a cross-sectional view of an end panel 20 having one tongue or groove edge 21 and a rolled edge 22.

Figure 5:
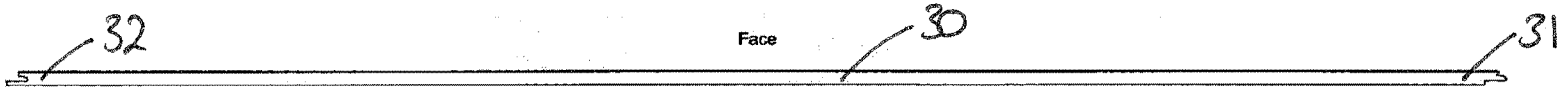
FIG. 5 shows a cross-sectional view of a wall panel in accordance with another preferred embodiment.

FIG. 5 shows a cross-sectional view of an intermediate wall panel 30 with tongue and groove edges 31 and 32.

Figure 6:
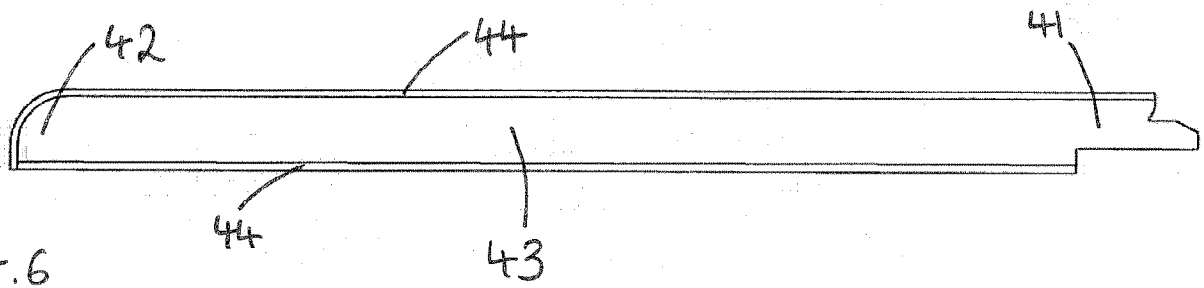
FIG. 6 shows a cross-sectional view of a wall panel in accordance with a further preferred embodiment.

FIG. 6 shows a cross-sectional view of an end strip 40 with one tongue or groove edge 41 and a rolled edge 42. In this figure, the core 43 and laminates 44 can be seen. All panels in accordance with the invention are formed with a core and laminate, as described further below.

Figure 7:
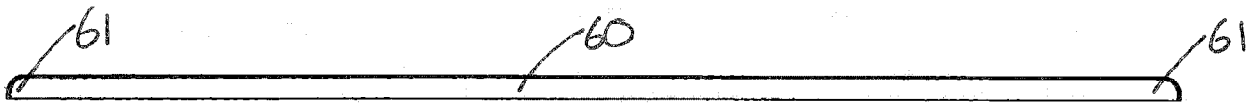
FIG. 7 shows a cross-sectional view of a wall panel in accordance with a still further preferred embodiment.

FIG. 7 shows a cross-sectional view of a further embodiment of a wall panel 60 in accordance with the invention, which is provided with rolled edges 61 at each end.

Figure 8:
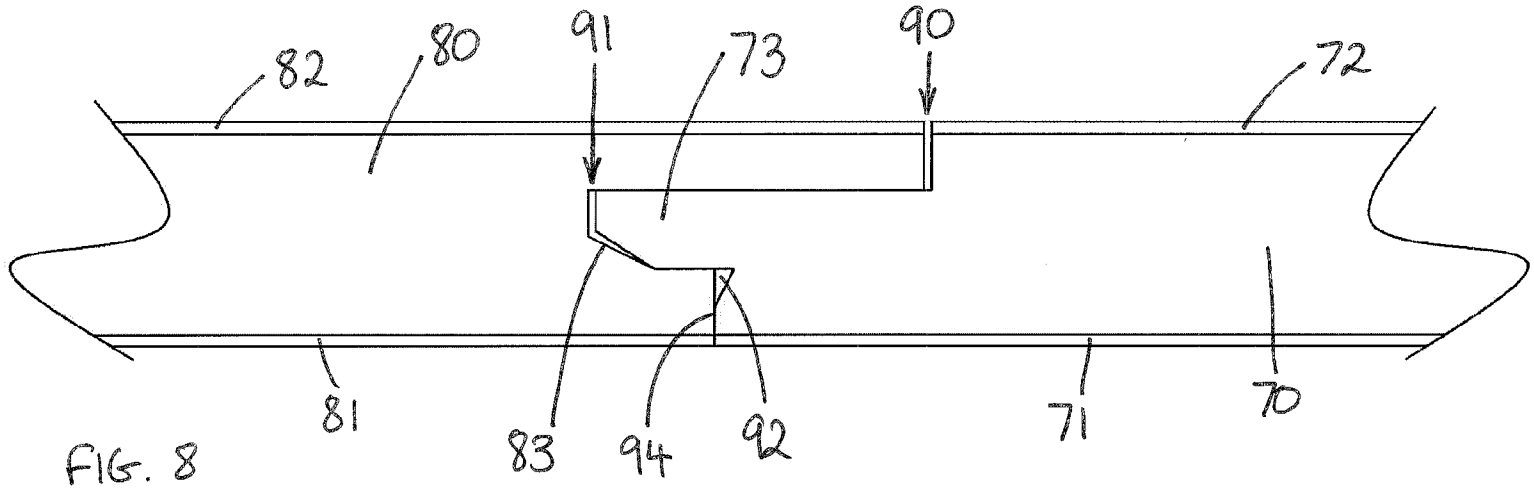
FIG. 8 shows an enlarged cross-sectional view of a tongue and groove engagement between two wall panels in accordance with the invention.

FIG. 8 shows an enlarged cross-sectional view of a tongue and groove engagement between two wall panels 70 and 80 in accordance with the invention. The panels have front laminates 71 and 81 and rear laminates 72 and 82.

The tongue and groove system is designed such that contact between the two panels in the orthogonal direction (i.e. across the thickness of the panels) is minimised and is concentrated at the front face of the panels. This achieves a tight join at the front face and eliminates a visible gap. It also increases tolerance for machining errors or variation.

Panel 70 is provided with a tongue 73 and panel 80 is provided with a groove 83. When the panels are fully interlocked, gaps 90, 91 and 92 are designed to exist and contact area 94 is kept relatively small and located at the front face of the panels. These features also provide a certain amount of tolerance in the event that the wall onto which the panels are being installed is not perfectly planar but is bowed or uneven to a certain extent. Gaps 90, 91 and 92 also provide an overspill reservoir for adhesive. Gap 92 is a notch cut into the side face of the panel. Tongue 73 is provided with a bevel 74 which allows the panel to be inserted at an angle. This feature is useful when installing up to a fixed end.

The wall panels described above are made from a core of wood plastics composite (WPC) material covered with a laminate which is bonded to the core by means of polyurethane (PUR) adhesive. The resulting panel is water-impervious and the system does not require the use of joining extrusions between the panels. This simplifies installation and reduces cost. The combination of materials in the panels themselves results in a panel which is not only water-impervious but also has excellent insulating characteristics which will help retain room temperature and reduce wall panel surface condensation. The three main materials employed in the construction of the panels are discussed separately below.

Face and Backing Laminates

Both face and backing laminates are high pressure laminates. Face laminates can be plain or decorative, whereas backing laminates are likely to be plain. Preferred laminates are manufactured using layers of Kraft paper impregnated with phenolic resins, decorative paper impregnated with melamine resin and printed decors which are protected using durable overlay covering. Resin impregnated layers are fused together under high pressure and temperature to activate the melamine and phenolic resins resulting in a robust fused waterproof surface.

WPC Core

WPC is a relatively recent material which combines plastics with wood fibre. WPC can be injection moulded to form shapes or extruded to make mouldings and sheets. The core substrate of panels in at least preferred embodiments will be WPC foamed board. The main ingredients of WPC boards are 50% PVC and 20% wood fibre. Fillers, stabilisers, lubricants and foaming agent make up the remaining 30%. Recycled PVC and wood fibre materials can be used to manufacture WPC boards. WPC boards are water and weather proof, naturally fire retardant due to their high PVC content, rot proof and can be worked with standard wood working tools. They are therefore very suitable for use in a bathroom material.

Bonding Adhesive

The WPC substrate and laminate sheets are both waterproof. The preferred adhesive for use as the bonding adhesive is also waterproof, and is preferably a high performance waterproof PUR (polyurethane) adhesive.

The invention claimed is:

1. A water impervious wall panel system comprising:

an intermediate first wall panel composed of a core of wood plastics composite composed of PVC and wood fibre and a high pressure laminate adhesively attached to the core, wherein the intermediate first wall panel is provided with tongue-and-groove edges;

an end second wall panel composed of a core of wood plastics composite composed of PVC and wood fibre and a high pressure laminate adhesively attached to the core, wherein the end second wall panel is provided with a tongue-and-groove edge and a rolled edge;

wherein one of the tongue-and-groove edges of the intermediate first wall panel and the tongue-and-groove edge of the end second wall panel form an interlocking system having a contact area adjacent to a front face of the intermediate first wall panel and the end second wall panel and a gap adjacent a rear face of the intermediate first wall panel and the end second wall panel, the contact area extending across less than the thickness of the intermediate first wall panel and the end second wall panel so as to provide a tight joint at the front face and eliminate visible gaps.

2. The wall panel system of claim 1, wherein the core is a wood plastics composite foamed board.

3. The wall panel system of claim 2, wherein the wood plastics composite includes recycled materials.

4. The wall panel system of claim 1, wherein the adhesive is a polyurethane adhesive.

5. The wall panel system of claim 1, wherein the laminate is attached to both major surfaces of the core.

6. The wall panel system of claim 1, wherein the tongue is provided with a bevelled edge.

* * * * *